US005884768A

United States Patent [19]

Fox

[11] Patent Number: 5,884,768

[45] Date of Patent: Mar. 23, 1999

[54] IN OR RELATING TO CONTAINERS

[75] Inventor: Giles Fox, Marlborough, Great Britain

[73] Assignee: The Computer Luggage Company Limited, Great Britain

[21] Appl. No.: 824,804

[22] Filed: Mar. 26, 1997

[51] Int. Cl.[6] ..... B65D 85/38; B65D 81/05

[52] U.S. Cl. ..... 206/522; 206/305; 206/320

[58] Field of Search ..... 206/305, 320, 206/522; 190/119, 902

[56] References Cited

U.S. PATENT DOCUMENTS

| | | | |
|---|---|---|---|
| 3,477,553 | 11/1969 | Kish, Jr. | 190/119 |
| 3,949,879 | 4/1976 | Peterson et al. | 206/522 |
| 4,574,953 | 3/1986 | Garbuzov | 206/522 |
| 4,773,534 | 9/1988 | DeHeras et al. | 206/522 |
| 4,801,213 | 1/1989 | Frey et al. | 383/3 |
| 5,217,131 | 6/1993 | Andrews | 206/522 |
| 5,242,056 | 9/1993 | Zia et al. | 206/320 |
| 5,340,632 | 8/1994 | Chappuis | 428/71 |
| 5,437,367 | 8/1995 | Martin | 206/320 |
| 5,445,266 | 8/1995 | Prete et al. | 206/305 |
| 5,524,754 | 6/1996 | Hollingsworth | 206/320 |
| 5,570,780 | 11/1996 | Miller | 206/532 |
| 5,624,035 | 4/1997 | Kim | 206/522 |

FOREIGN PATENT DOCUMENTS

| | | |
|---|---|---|
| 598247 | 2/1948 | United Kingdom . |
| 1224493 | 3/1971 | United Kingdom . |
| WO 90/14942 | 12/1990 | WIPO . |
| WO 93/06025 | 4/1993 | WIPO . |

*Primary Examiner*—Jim Foster

*Attorney, Agent, or Firm*—Gifford, Krass, Groh, Sprinkle, Anderson & Citkowski, P.C

[57] ABSTRACT

A container having cushioning means for protecting the contents of the container against shock damage, the cushioning means comprising one or a plurality of enclosed volumes or cells housing a fluid which may be a gas such as air and defined by an at least partly resilient envelope which forms part of the structure of the container.

1 Claim, 3 Drawing Sheets

IN OR RELATING TO CONTAINERS

BACKGROUND OF THE INVENTION

The present invention relates generally to containers, and particularly to a container for portable shock-sensitive equipment. In one particular embodiment the container of the invention may be formed as a carrying case for electronic or electrical equipment. The present invention finds particular, although not exclusive, application as a carrying case for a computer.

The popularity of so-called lap top or notebook type of portable computers has increased greatly recently, and many people find it a great convenience to be able to carry a small, portable computer from one work place to another, or between their place of work and home. This allows them greater freedom and flexibility in organising their working life. Computers, however, are relatively shock-sensitive items of high value which must be treated with care in order to preserve their functionality. Such shocks and impacts would at least damage or distort their casing, and at worst cause internal damage possibly resulting in malfunction or even total breakdown of the computer.

Specialist luggage in the form of carrying cases for computers is available on the market, and this very often incorporates padded or lined wall structures which serve at least to some extent to absorb impacts or shocks encountered during travelling, for example should the user drop it or have it knocked from their grasp. Although known padded bags or cases are able to absorb the minor impacts from jostling crowds and occasional striking against adjacent objects such as tables or chairs as the bag or case is carried from place to place, larger impacts, especially should the computer be dropped, are not fully absorbed and these can still result in distortion of the casing and/or internal damage to the computer.

OBJECTS OF THE INVENTION

The main object of the present invention is to provide a container, suitable for, but not exclusively for, carrying computers and the like shock-sensitive equipment or contents, having a greater ability to absorb impacts than conventional, prior art padded cases or containers.

A secondary object of the invention is to improve the protection afforded by a container such as a carrying case without increasing the weight of the container and having a negligible effect on the dimensions whilst nevertheless offering a higher degree of protection.

SUMMARY OF THE INVENTION

According to one aspect of the present invention, a container for portable, shock-sensitive equipment, such as a computer or the like, having cushioning means for protecting the contents of the container against shock damage, is characterised in that the cushioning means comprise one or a plurality of enclosed volumes housing a fluid and defined by an at least partly resilient envelope which forms at least part of the structure of the container.

One advantage of the use of enclosed fluid-filled volumes for shock absorption lies in the fact that with the fluid retained in the envelope defining the enclosed volumes these latter can change in shape to spread the load of an impact. Moreover, if desired, the fluid can be placed under a pressure which may be chosen in dependence on the nature of the contents to be conveyed and the particular form of the envelope.

In one embodiment of the invention the fluid-filled volumes may be formed as separate pockets or enclosures independent from one another and housed within a larger enclosure. In this embodiment the individual envelopes may be of any convenient shape from spherical or tetrahedral to rectangular "cushion-shape" elements, and the larger enclosure within which they are contained may comprise a side wall panel or a bottom of the container or carrying case. By incorporating the fluid-filled volumes in the structure of the container a very effective shock absorption can be achieved with a structure of small dimensions so that the excess size of a padded container is avoided. The number of individual elements within a given volume of the larger enclosure will determine the degree of resistance since the ability of the separate pockets or envelopes to move in relation to one another will depend on the proportion of the enclosure filled by such elements. The fluid within the containment volume may be a gas, conveniently air, but other gases may be used if preferred or if their particular properties lend themselves to such use.

The interior of the container may be at least partly conformed to the shape of the intended contents (which is especially useful in the case of dedicated computer cases) and there may be a plurality of individual compartments for receiving different items. Such compartments may be at least partly defined by separation partitions which can be fitted or fixed in selected positions within the interior of the casing. Conveniently the partition may be a flexibly resilient element and the fixing may be releasable. It is especially convenient to use hook and loop fasteners of the type sold under the Trade Mark VELCRO (RTM).

In a particularly useful embodiment the internal volume of the container is partitioned by a separator member having releasable fastening means at each end thereof engageable with at least the surfaces of the said fluid-filled pockets whereby to retain the partition in a selected position defining a reduced volume within the container. In addition there may be provided at least one internal restraint strap secured at one end to the container at or adjacent the junction between the back panel and the bottom and fastenable at the other end to fastening means acting to retain the restraint strap under tension whereby to retain a body engaged thereby in position against the back wall panel of the container.

One or more of the container walls may comprise or include one or a plurality of such gas-containment volumes forming the cushioning means.

The envelope defining the gas-containment volume may comprise a layer of flexibly resilient material defining at least one wall of each of a plurality of individual gas-containment volumes or pockets. Alternatively, the envelope defining the gas-containment volume may comprise two layers of flexibly resilient material with a plurality of partitions separating the space between them into a plurality of individual gas-containment volumes.

As well as this, the material from which at least a part of the container is made may itself be formed with one or a plurality of gas-containment volumes which receive and retain gas under pressure. It is envisaged that the base of a carrying case is the most likely candidate for provision with such cushioning means, and the base may in one embodiment be formed as a relatively thick resilient material incorporating a number of chambers substantially closed to the outside and filled with a gas, which may be under pressure. Techniques for producing integrally moulded such structures may include those in which the moulding takes place under pressure such that the entrapped gas is at superatmospheric pressure upon forming the layer, or processes in which gas under pressure is introduced into the compartments or pockets is subsequent to manufacture, suitable means for sealing the introduction route being provided.

In a preferred embodiment of the invention a container for portable shock-sensitive equipment is characterised in that it comprises a bottom, substantially parallel front and back panels, opposite end panels and a top having a carrying handle, the front panel being hingedly connected to the bottom, and connectable by elongate releasable fastener means to the end panels and the top along respective edges thereof, and in that each of the enclosed volumes of the cushioning means comprises fluid-filled pockets having a membrane wall which is convex towards the interior of the container. Again the fluid may be gas.

The envelope defining the fluid-containment volume may alternatively comprise two layers of flexibly resilient material with a plurality of partitions separating the space between them into a plurality of individual containment volumes. At least some of the said plurality of containment volumes may intercommunicate with one another although, preferably, the containment volumes are all entirely independent of one another.

A similar shock-protection or cushioning effect can be achieved in a structure in which the said membrane wall extends continuously over at least several adjacent pockets and is attached to the said bottom of the container between adjacent pockets. Preferably, in such a structure, the attachment of the said membrane wall to the said bottom between adjacent pockets is achieved by adhesive and/or by welding the material of the membrane to the said bottom at least between the said pockets whereby to define them.

In view of its intended use to absorb impacts and shocks, the containment volume envelopes are preferably made of a material sufficiently resistant to tearing or rupture as to be substantially non-rupturable in use.

In embodiments of the invention in which the container has a bottom wall, sides and a top, the cushioning means may be incorporated in at least the said bottom wall. The cushioning means may, however, alternatively extend entirely over, or over at least part of, the side walls, the end walls and/or the top.

In this specification the term "fluid" is to be understood to include (but without limitation) gas, liquid or gel. All of the previous and subsequent discussion of fluid-filled cell structures and embodiments is also equally relevant to gas-filled embodiments.

Other features and advantages of the present invention will become apparent from a study of the following description given with the aid of the accompanying drawings which are provided purely by way of nonlimitative example.

DESCRIPTION OF THE PREFERRED EMBODIMENTS

Figure 1:
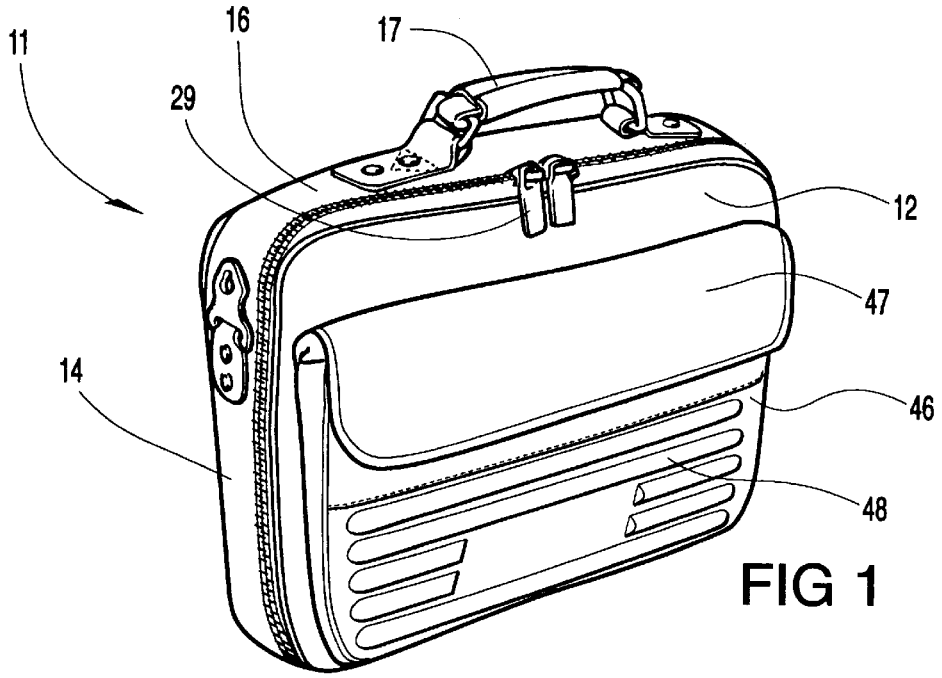
FIG. 1 is a perspective view of a carrying case adapted for carrying a portable or lap top computer.

Referring now to the drawings, the carrying case 11 illustrated in FIGS. 1 to 4 comprises a soft fabric enclosure having two main substantially parallel enclosure panels comprising a front panel 12 and a rear panel 13. The rear panel 13 has a surrounding perimetral edge comprising respective end walls 14, 15 and a top 16, this latter provided with a carrying handle 17, for which purpose the top 16 may be reinforced below by means (not shown) which give it sufficient stiffness to resist the load imposed on it by the handle 17. The end walls 14, 15 meet the top 16 at respective corners 18, 19 and adjacent these corners are respective reinforced connectors 20 for a shoulder strap (shown only in FIG. 3).

It should be appreciated that the material from which the case 11 is made comprises a relatively flexible abrasion-resistant sheet material which may be a woven fabric of natural or artificial fibres, or may be an extruded homogenous material such as a plastics sheet. Each of the main panels 12, 13 is secured at its lower edge 21, 22 to a corresponding edge of a flat substantially rectangular base element or bottom generally indicated 10. The end walls 14, 15 meet the ends of the base element 10 at lower corners 25, 26 which like the upper corners 18, 19 are rounded to join the end walls 14, 15 smoothly.

Figure 2:
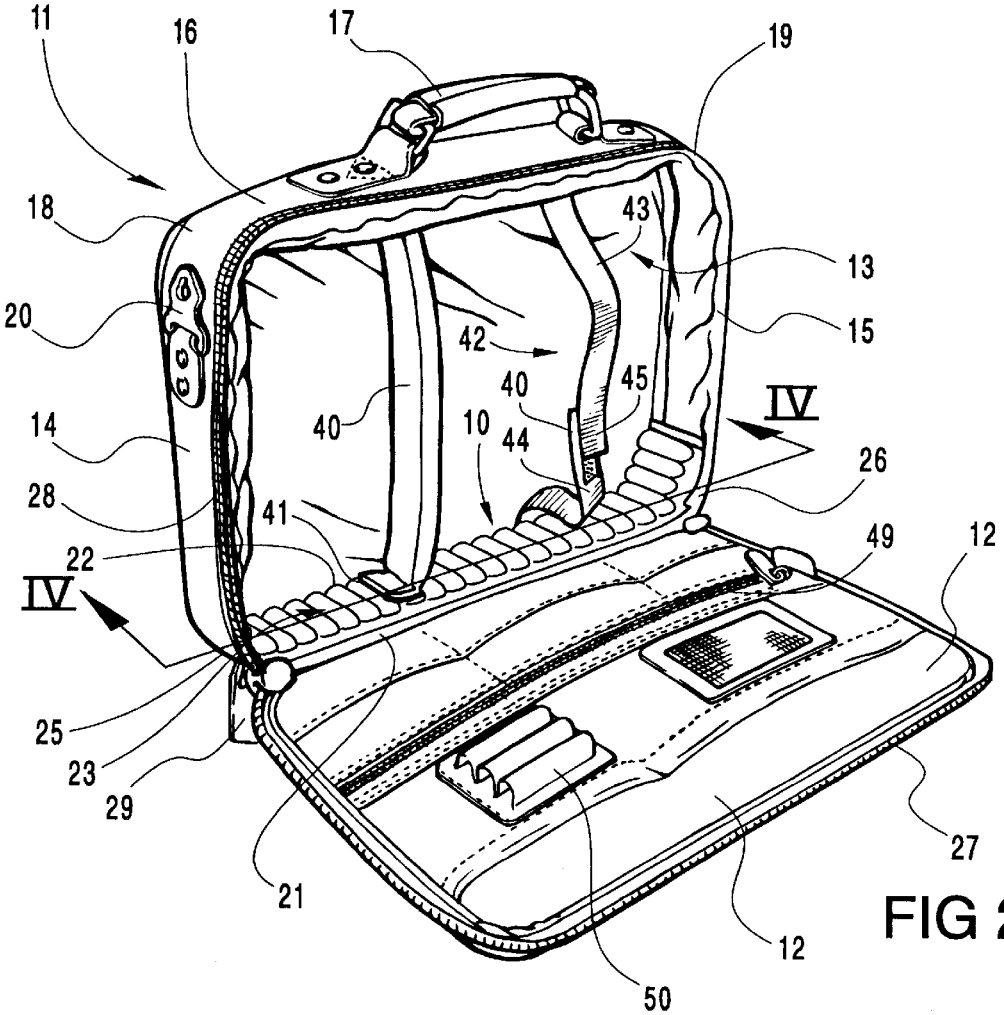
FIG. 2 is a perspective view of the case of FIG. 1 shown with the front panel opened to reveal the inside of the bottom.

The perimetral edge 27 of the front panel 12 and the corresponding perimetral edge 28 defined jointly by the end walls 14, 15 and the top 16 are provided with cooperating parts of a sliding clasp fastener, the sliding clasp 29 of which can be moved between a closure position as illustrated in FIG. 1 to an open position as illustrated in FIG. 2.

Figure 3:
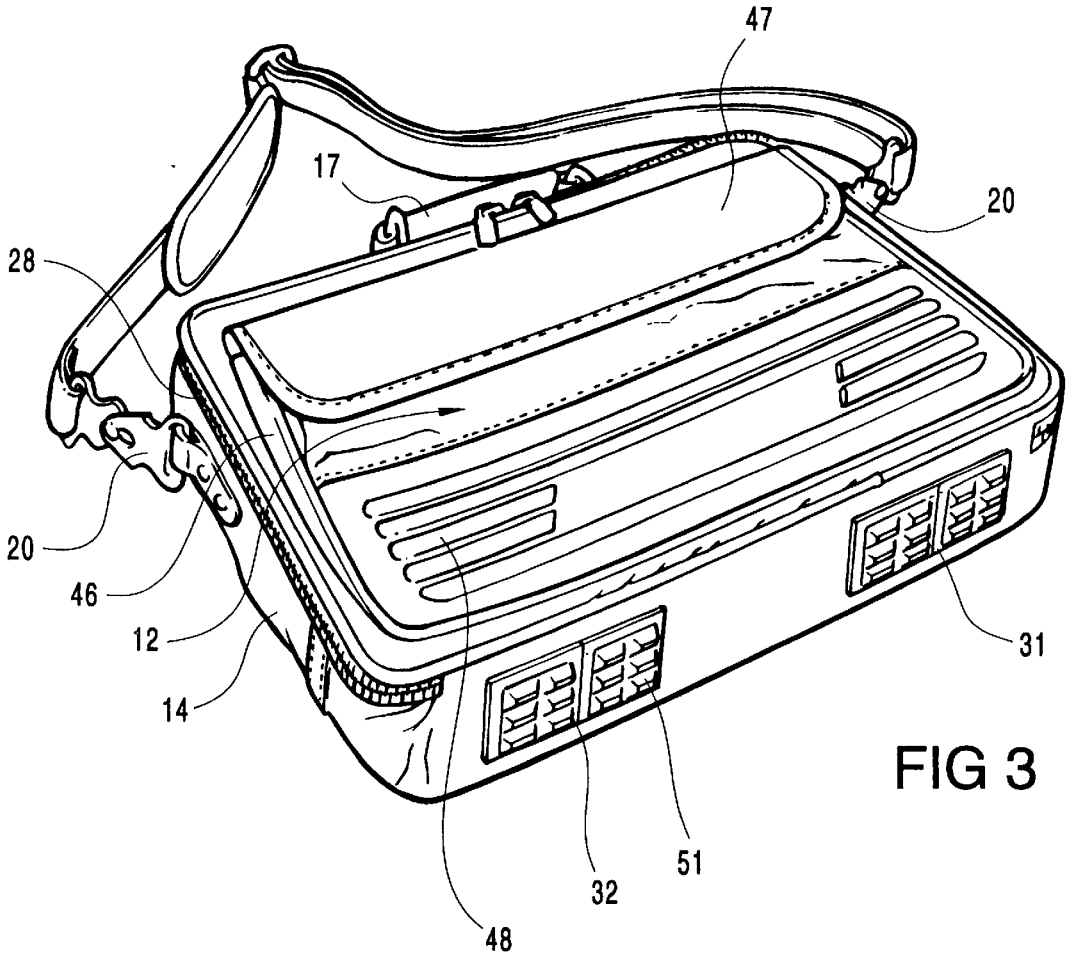
FIG. 3 is a perspective view from below of the carrying case, showing the protective feet.
Figure 4:
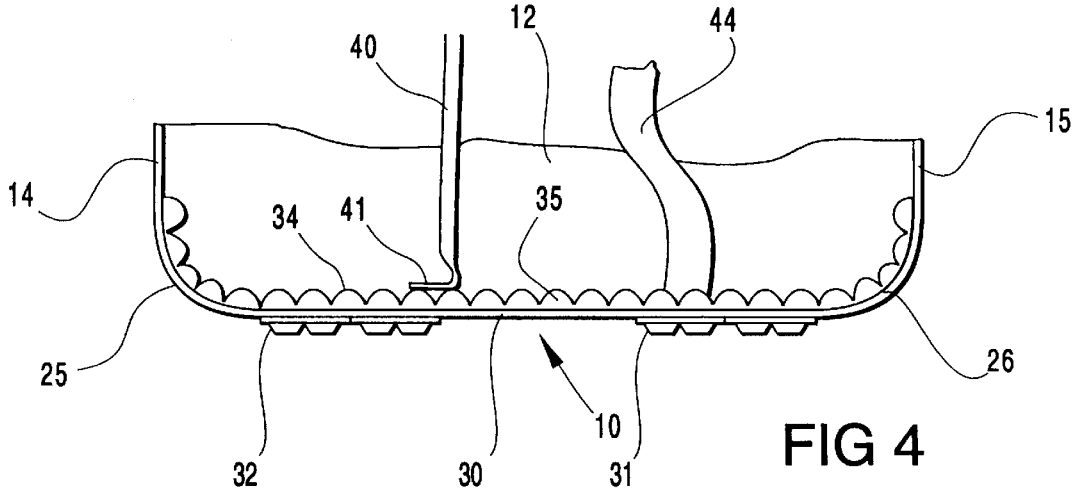
FIG. 4 is a partial sectional view taken on the line IV—IV of FIG. 2.

The bottom or base 10 is formed as a substantial impact-absorbing member by. incorporating a plurality of air cells or pockets of gas (preferably air) and its structure is shown in more detail in FIG. 4. The base 10 is approximately rectangular and comprises a lower layer 30 of resiliently flexible plastics material the thickness of which is sufficiently great to give it a high strength and resistance to tearing or rupture, and to which are attached feet 31, 32 by means (not shown) which feet space the bottom layer 30 of the base 10 from the ground when the case 11 is set down in normal use, but which also spread the load of the case over a substantial area. As can be seen in FIG. 3 the feet 31, 32, which may be made of rubber, have a plurality of ribbed pyramid projections which act further to absorb the shock of impact if the case 11 is dropped.

The upper surface of the base 10 is composed of a plurality of individual envelopes or pockets 23 each having an elongate rectangular plan form as seen best in FIG. 2, and each being substantially independent from its neighbours and secured to the underlying layer 30 by welding, adhesive or other suitable means of an upper membrane 34 defining the envelopes or pockets 23. The upper surface of the membrane 34 is composed of a loop pile fabric such as forms part of a hook and loop fastener.

The envelopes 23 may alternatively be integrally formed with the bottom wall 28 so that no separate bonding of edges is required. The envelopes 23 have respective domed tops and each defines a containment volume 35 within which is housed a gas, typically air, to form a plurality of pockets or air cells 23. The array of pockets or cells 23 comprises a single row of substantially elongate transversely extending elongate rectangular cells defining a (discontinuous) support surface for an item to be carried in the case 11, such as a portable or lap top computer. The resiliently flexible laminar material 34 of which the pockets or cells 23 are composed, like the resiliently flexible sheet material 30 of the base, allows the enclosed volumes 35 to change shape when the shape of the envelope 23 is distorted, for example due to pressure by contact with an applied force. Compression of the gas within the containment volume 35 allows the element as a whole to absorb the shocks and impacts to which the base 10 may be subject in use, especially if, for example, the case 11 were dropped whilst housing a relatively heavy computer. Typically, lap top computers weigh in the region of 2 kg and if it is assumed that the whole weight of the computer may be born by just two or three of the pockets if the case 11 were to be dropped carelessly to land on one corner, it will be appreciated how the ability to deform resiliently to a large extent allows the shock loading to be reduced to tolerable levels. As will be seen from FIG. 2 the row of cells 23 extends around each lower corner 25, 26 and part-way up each end wall 14, 15 in order to provide a wrap-around protection.

In this embodiment the base 10 is an integral part of the case 11, and the main panels 12, 13 and end walls 14, 15 are all permanently and securely fixed thereto by the manufacturing process by incorporating this base within the structure by stitching and/or adhesive or welding.

Spanning the interior volume of the case 11 from the top 16 to the bottom or base 10 is an internal partition 40 comprising a padded resiliently flexible elongate strip having folded tab ends 41 (only the lower one of which is visible in FIG. 2) on each of which is carried the hook part of a hook and loop fastener by which the partition 40 can be located in any selected position along the length of the row of air cells defined by the pockets 23. The inside faces of the end walls 14, 15 and the top 16 have linings of the loop fabric so that the partition member 40 may be located in any selected position and/orientation within the container.

A restraining strap 42, comprising an upper strap element 43 and a lower strap element 44 the ends 45, 46 of which can be connected, again using hook and loop fastener of the type sold under the Trade Mark VELCRO (RTM) assist in securing a contained item within the case.

The front panel 12 has, on the outside, a document pocket 46 with a closure flap 47 (again closed by VELCRO type fasteners) and a plurality of elongate padded strips 48 which may be strips of resilient material or enclosed elongate air cells like the air cells 23 of the bottom 20.

Within the front panel 15 are a further interior pocket, closable by a sliding clasp fastener 49 and a set of fixings for writing instruments generally indicated 50.

The end walls 14, 15 and top 16, as well as the front and back panels 12, 13 may also be additionally padded between outer and inner layers.

Figure 5:
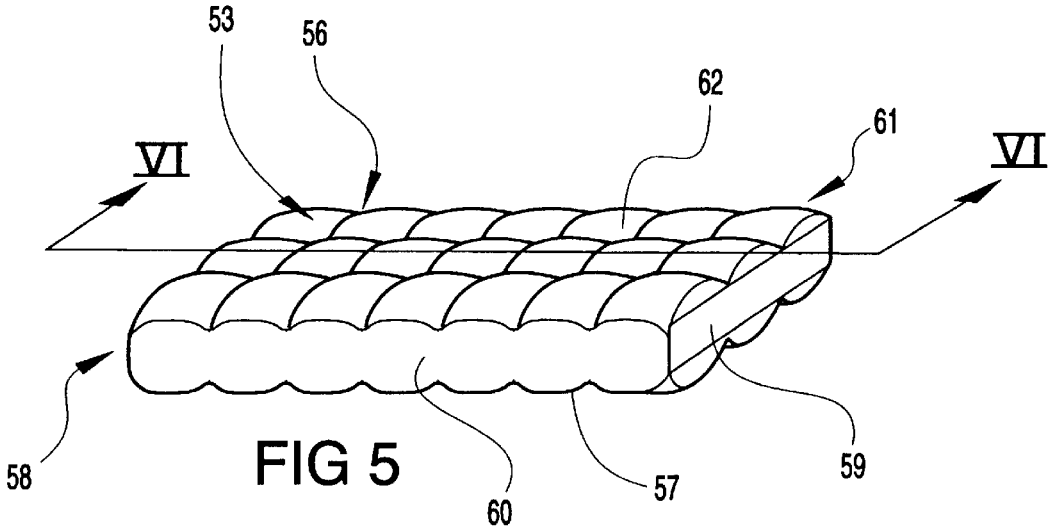
FIG. 5 is a perspective view of a different form of base structure formed as a second embodiment of the invention.
Figure 6:
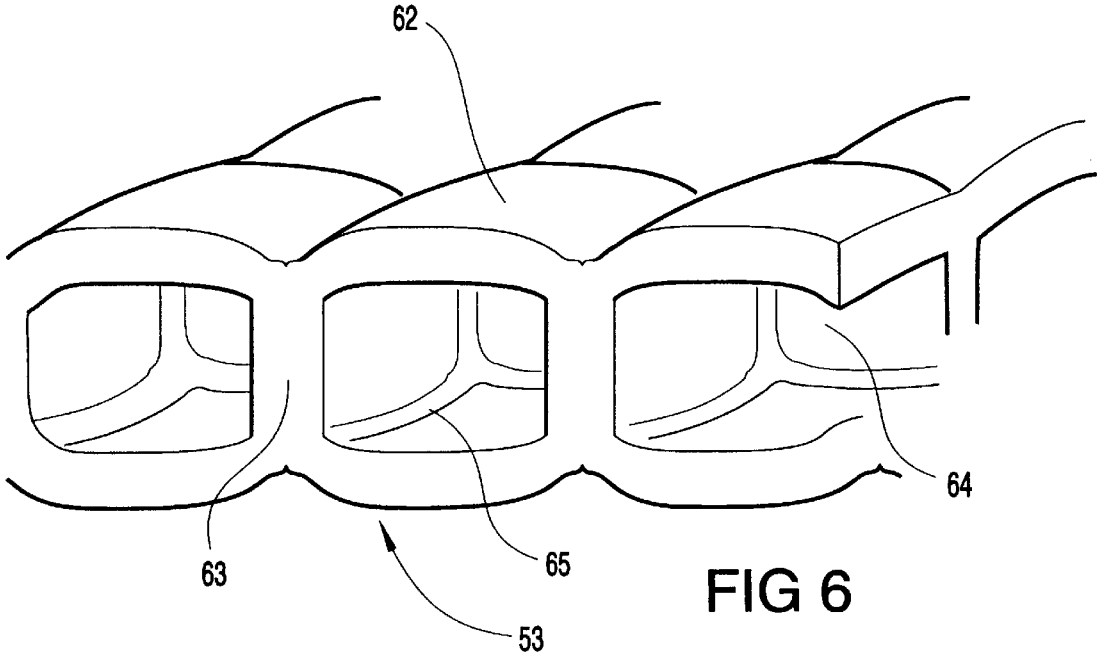
FIG. 6 is a partial sectional view taken on the line VI—VI of FIG. 5.

FIGS. 5 and 6 show an alternative cushion element 53 suitable for incorporation into a bag or carrying case for computers to form part of the structure thereof. Externally, the element 53 comprises substantially parallel upper and lower major faces 56, 57, end walls 58, 59 and longitudinal side walls 60, 61. The major faces 56, 57 exhibit an array of slight bulges 62.

The internal structure of the element 53 can be seen in FIG. 6. The major faces 56, 57 are spanned by a plurality of transverse partitions 63 and longitudinal partitions 64 separating the interior volume of the element 53 into a plurality of cells or pockets 65, each of which contains a gas (preferably air) under pressure.

In use the cushion element 53 acts as a resilient mattress to cushion any impact to which the case 11 may be subject in use, for example by being set down heavily or by being dropped, thereby absorbing the shock of impact and protecting the interior contents, which typically may be a computer as discussed above, from damage.

What is claimed is:

1. A container for transporting portable shock-sensitive equipment, the container having cushioning means for protecting contents held within the container against shock damage, wherein the cushioning means comprise a plurality of fluid-filled pockets, each of which being further defined by an at least partly resilient envelope which forms at least part of a structure of the container, an internal volume of the container being partitioned by a separator member having releasable fastening means at each end thereof, at least one end of the fastening means being engageable with selected surfaces of the fluid-filled pockets whereby to retain the partition in a selected position defining a reduced volume within the container.

* * * * *

UNITED STATES PATENT AND TRADEMARK OFFICE

CERTIFICATE OF CORRECTION

PATENT NO. : 5,884,768

DATED : March 23, 1999

INVENTOR(S) : Giles Fox

It is certified that error appears in the above-identified patent and that said Letters Patent is hereby corrected as shown below:

On the title page;

--[30] Foreign Application Priority Data

Mar. 29, 1996 [GB] United Kingdom.....9606705--, in accordance with the present style for presentation of such data.

Signed and Sealed this

Fourteenth Day of December, 1999

*Attest:*

*Attesting Officer*

Q. TODD DICKINSON

*Acting Commissioner of Patents and Trademarks*